US006280363B1

(12) United States Patent
Harrell

(10) Patent No.: US 6,280,363 B1
(45) Date of Patent: Aug. 28, 2001

(54) RECIPROCATING THERAPEUTIC EXERCISER

(75) Inventor: Radford Harrell, West Des Moines, IA (US)

(73) Assignee: Osborn Medical Corporation, Utica, MN (US)

( * ) Notice: Subject to any disclaimer, the term of this patent is extended or adjusted under 35 U.S.C. 154(b) by 0 days.

(21) Appl. No.: 09/372,260

(22) Filed: Aug. 11, 1999

(51) Int. Cl.[7] ..... A63B 22/06
(52) U.S. Cl. ..... 482/57; 482/63
(58) Field of Search ..... 482/51, 52, 53, 482/57, 58, 59, 60, 63

(56) References Cited

U.S. PATENT DOCUMENTS 5,496,238 * 3/1996 Taylor ..... 482/63

* cited by examiner

*Primary Examiner*—Mickey Yu
*Assistant Examiner*—Tam Nguyen
(74) *Attorney, Agent, or Firm*—D L Tschida

(57) ABSTRACT

A pedal powered exerciser including a pair of independent reciprocating push pedal drives. A pedal at each drive operates a chain trained between an idler axle and an independent live half axle. Inertial movement is sustained with a flywheel and overrunning clutch assembly at each live axle. Kinetic resistance at each live half axle can be selectively varied with a magnetic tension control assembly. A tubular framework supports the pedal slides, chains, flywheels, and magnetic tensioners. A pneumatic piston is hinged to self-adjust the angular orientation between main and base frames. A telescoping clamp assembly includes upper and lower jaws that are adapted to mount to a recliner footrest. The clamp assembly is longitudinally adjustable and detachable from a receiver to permit transport.

17 Claims, 5 Drawing Sheets

RECIPROCATING THERAPEUTIC EXERCISER

BACKGROUND OF THE INVENTION

The present invention relates to exercise equipment and, in particular, to a portable, pedal-powered, therapeutic exercise assembly that mounts to a conventional chair (e.g. a recliner) and includes independent reciprocating flywheel drives with magnetic tension controls.

Numerous types of pedal powered exercisers (i.e. exercise bikes) have been developed to exercise a user's cardiovascular system and maintain muscle tone. The bikes are typically found in workout rooms and gymnasiums. The bikes are stationary, yet exercise the legs and cardiovascular system in much the same fashion as riding a bicycle outdoors or running on a treadmill. The bikes include an integral seat and a pair of pedals that are coupled to a controlled resistance assembly. Typically, an adjustable brake pad assembly selectively cooperates with pedal motion to vary the degree of energy necessary to induce pedal movement.

Stationary, indoor exercise or trainer assemblies have also been developed for use with conventional bicycles. A controlled resistance assembly supports the rear tire of the bicycle and maintains contact to resist tire rotation. The user operates the bike in normal fashion and shifts the gears as desired. The user is thereby able to ride a bicycle in-place while experiencing similar pedaling resistances as offered by a changing landscape.

Other therapeutic, pedal powered exercisers have also been developed for use by debilitated users as part of physical therapy programs. These exercisers are used at home and/or in institutional settings. Some of these exercisers mount to a bed, chair, table or other user support. The assemblies allow the user, while seated, lying or standing, to operate the drive mechanism and physically exercise the legs and/or arms. A doormounted exerciser is shown at U.S. Pat. No. 4,225,130. A bed-mounted exerciser is shown at U.S. Pat. No. 4,169,591. Numerous chair-mounted exercisers are shown at U.S. Pat. Nos. 3,968,963; 4,262,902; 4,739,984; 5,108,092; and 5,647,882. The latter exercisers include a pair of pedals that cooperate with an adjustable, direct resistance drive at a connecting axle. U.S. Pat. Nos. 4,824,132; 5,299,995; and 5,472,396 disclose assemblies having pedals that operate a single chain, belt or cable drive that cooperates with an interconnected resistance device.

The present therapeutic exercise assembly was developed to accommodate users with limited physical strength. For example, the elderly, dialysis patients or any other semi-ambulatory individuals who tire and become winded very easily. The exerciser provides a pair of independent reciprocating drives that operate along slide tracks at a folding, multi-section, adjustable framework. The framework is portable and adjusts vertically and laterally to fit a stationary chair and accommodate a user's seated posture and leg extension. Independent magnetic tension control assemblies are provided at the drives.

SUMMARY OF THE INVENTION

It is accordingly a primary object of the invention to provide a pedal powered exerciser that mounts to a chair.

It is a further object of the invention to provide an exerciser having an adjustable chair clamp and an interconnecting framework that facilitates mounting to a recliner footrest.

It is a further object of the invention to provide an exerciser having a pair of independent, reciprocating push pedals.

It is a further object of the invention to provide a kinetic resistance to pedal motion via integrated flywheels and over-running clutches.

It is a further object of the invention to provide an adjustable magnetic tension or resistance to pedal motion at each pedal drive.

It is a further object of the invention to provide controls for monitoring exercise activity.

Various of the foregoing objects, advantages and distinctions of the invention are obtained in one presently preferred exercise assembly that includes a pair of reciprocating push pedal drives. Each drive includes a pedal that extends from a slide plate that is secured to a slide rail with a number of rollers. The slide plate is coupled to a chain that is trained between sprockets mounted to an idler axle and an independent live half axle. Pushing motion against one pedal induces a raising of the other. Inertial movement is sustained with a flywheel and overrunning clutch assembly at each live axle. Kinetic resistance at each live axle is selectively varied with a magnetic tension control assembly that mounts to the live axle.

A tubular framework includes an elongated main frame that supports the pedals slides, chains, flywheels, and magnetic tensioners etc. of the drive assemblies. A chair clamp includes upper and lower jaws that extend from a tubular receiver and are adapted to mount to the footrest of a conventional recliner. The clamp assembly is longitudinally adjustable relative to the main frame at a telescoping slide adjuster. A pivoting spike coupler depends from the slide adjuster and is secured with a quick release to the tubular receiver.

A base frame includes support feet that stabilize the assembly. Rollers are fitted to the feet to facilitate transport. A pneumatic piston is hinged to self-adjust the angular orientation between the main and base frames as the main frame pedal drive assemblies are secured to a support chair. The base frame follows elevation adjustments by sliding toward or away from the chair. Elevation changes are accommodated with the relative extension and contraction of the piston as the slide adjuster and chair clamps are adjusted. Separate locking releases maintain the extension of the slide adjuster and position of the chair clamps.

Still other objects, advantages, distinctions and constructions of the invention will become more apparent from the following description with respect to the appended drawings. Similar components and assemblies are referred to in the various drawings with similar alphanumeric reference characters. The description should not be literally construed in limitation of the invention. Rather, the invention should be interpreted within the broad scope of the further appended claims.

Figure 1:
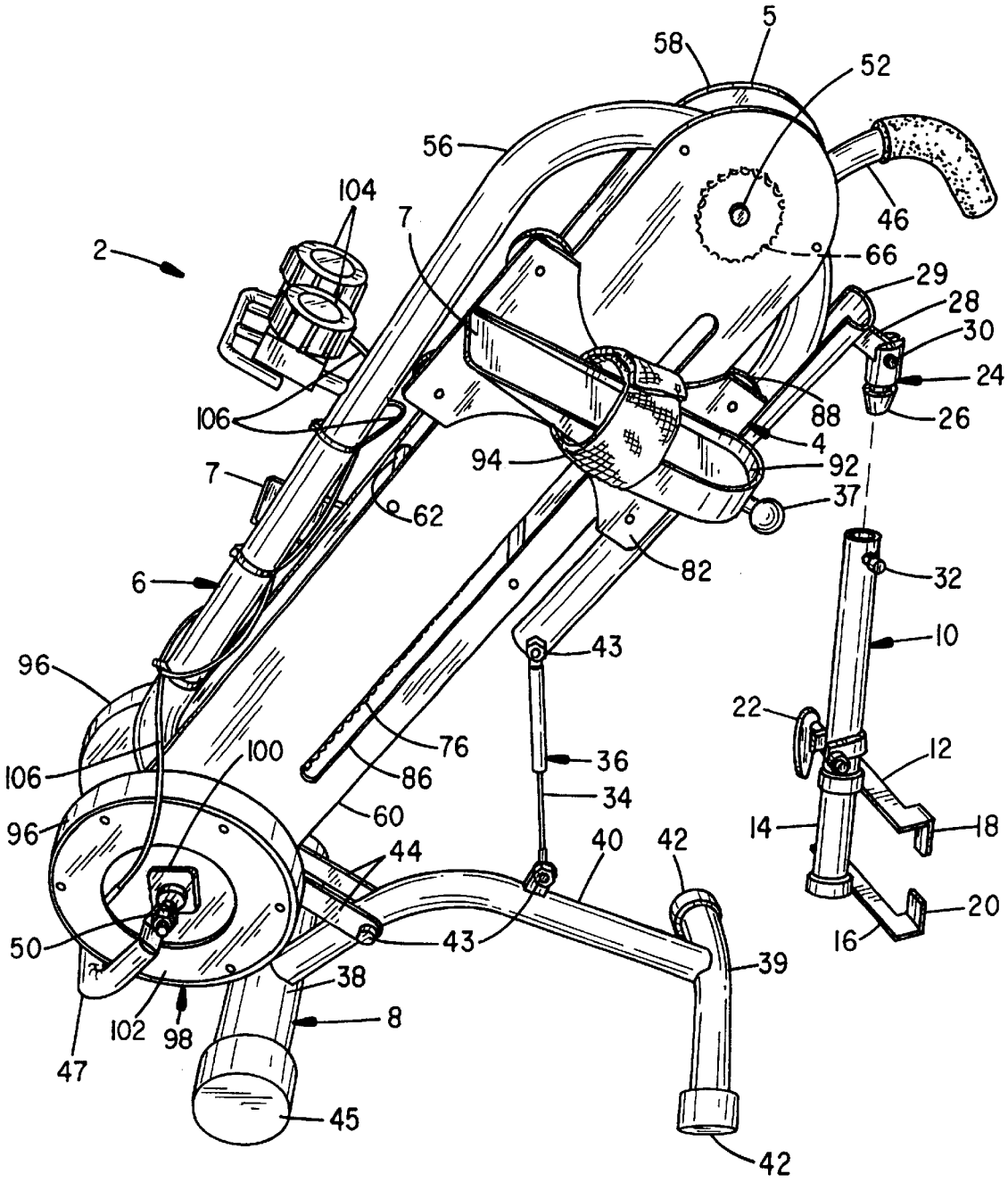
FIG. 1 is a perspective drawing of the exerciser showing the main frame elevated relative to the base frame and exposing the left pedal slide with the detachable chair clamps shown in exploded assembly.

Similar structure throughout the drawings is referred to with the same alphanumeric reference numerals and/or characters.

DESCRIPTION OF THE PREFERRED EMBODIMENT

Figure 2:
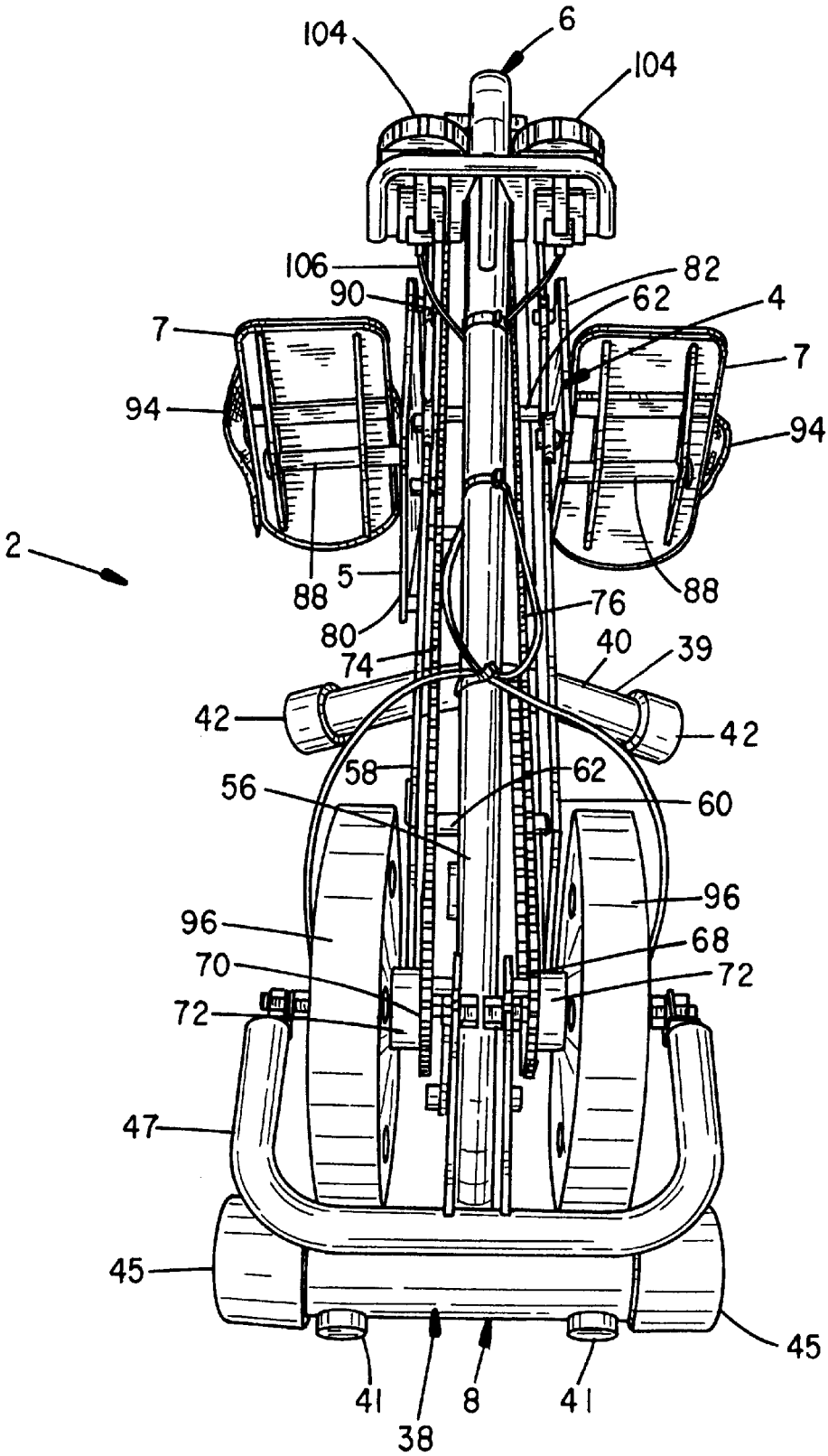
FIG. 2 is a perspective drawing showing a front view of the exerciser and exposing the reciprocating pedal slide rails, chain drives, magnetic tension assemblies and flywheels.

Referring to FIGS. 1 and 2, perspective views are shown to the portable, therapeutic exerciser 2 of the invention. The exerciser 2 provides a pair of independent, reciprocating, push-pedal drive assemblies 4 and 5 that are supported from a longitudinal main frame 6. The pedals 7 of the drive assemblies 4 and 5 are independently operable. Inertial and kinetic controls are provided to selectively and independently control pedal resistance at each leg relative to the physical abilities of the user.

The main frame 6 pivots at a base frame 8. The base frame 8 is normally supported on the floor and the main frame 6 is secured to a chair (not shown) at a clamp coupler assembly 10. The clamp coupler 10 includes an upper clamp arm 12 that is vertically adjustable along a post 14 relative to a stationary, lower clamp arm 16. The separation between the arms 12 and 16 is established in relation to bent tangs 18 and 20 at the ends of the arms 12 and 16. The tangs 18 and 20 typically mount behind a footrest platform of a recliner or the rungs or other convenient structure of a chair. A cam-acting latch 22 attached to the clamp arm 12 establishes a selected separation between the arms 12 and 16. An exploded assembly drawing to the clamp coupler 10 is shown at FIG. 3.

The configuration, number and/or positioning of the tangs 18 and 20 can be varied as necessary to fit one or more desired support chairs. The post 14 can be constructed as a multi-section, telescoping assembly in lieu of or in combination with the adjustable arms 12 and 16. Pin retainers or other conventional fasteners can be used to establish the extension of the post 14 and/or mounting location of the clamp arms 12 and/or 16 relative to holes provided in the post 14. In normal practice, the clamp assembly 10 is first secured to a chair and the main frame 6 and drive assemblies 4 and 5 are then secured to the post 14.

Figure 3:
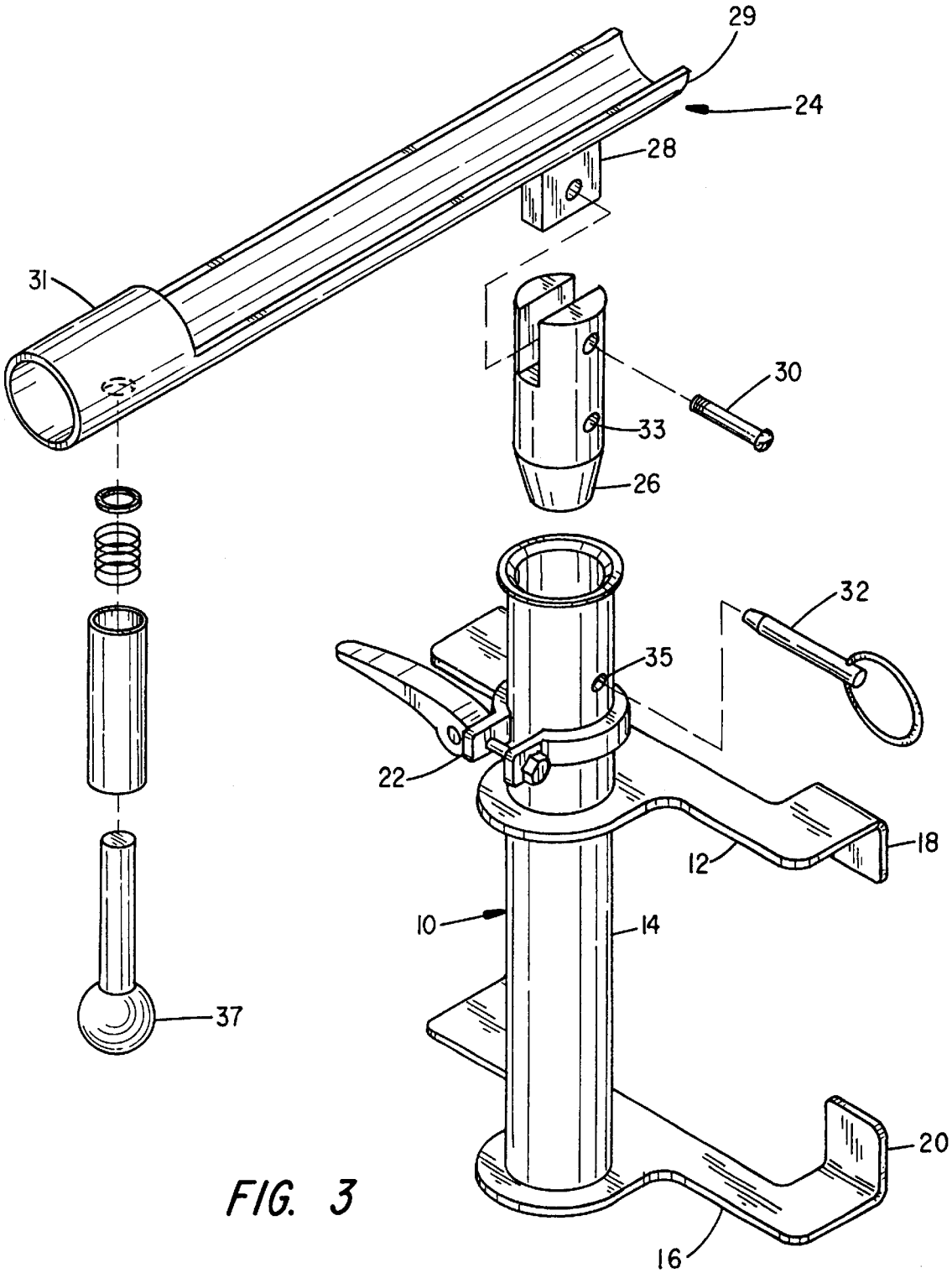
FIG. 3 is a perspective drawing shown in exploded assembly to the chair clamps, longitudinal slide adjuster and spike coupler.

With additional attention to FIG. 3, the drive assembly 4 is particularly secured to the post 14 at a slide coupler assembly 24. A spike 26 of the slide, coupler assembly 24 mates with the post 14. The spike 26 is mounted to a nosepiece 28 that depends from a sleeve 29. The sleeve 29 is slide mounted at a collar 31 to a lower, horizontal frame section 27 of the main frame 6. A pivot pin 30 retains the spike 26 to the nosepiece 28 and a removable latch pin 32 mates to a latch hole 33 at the spike 26 and hole 35 at the post 14. The pivot pin 30 allows the upper end of the main frame 6 to pivot as the spike 26 is secured to the clamp assembly 10, which was previously fitted to a support chair.

Figure 4:
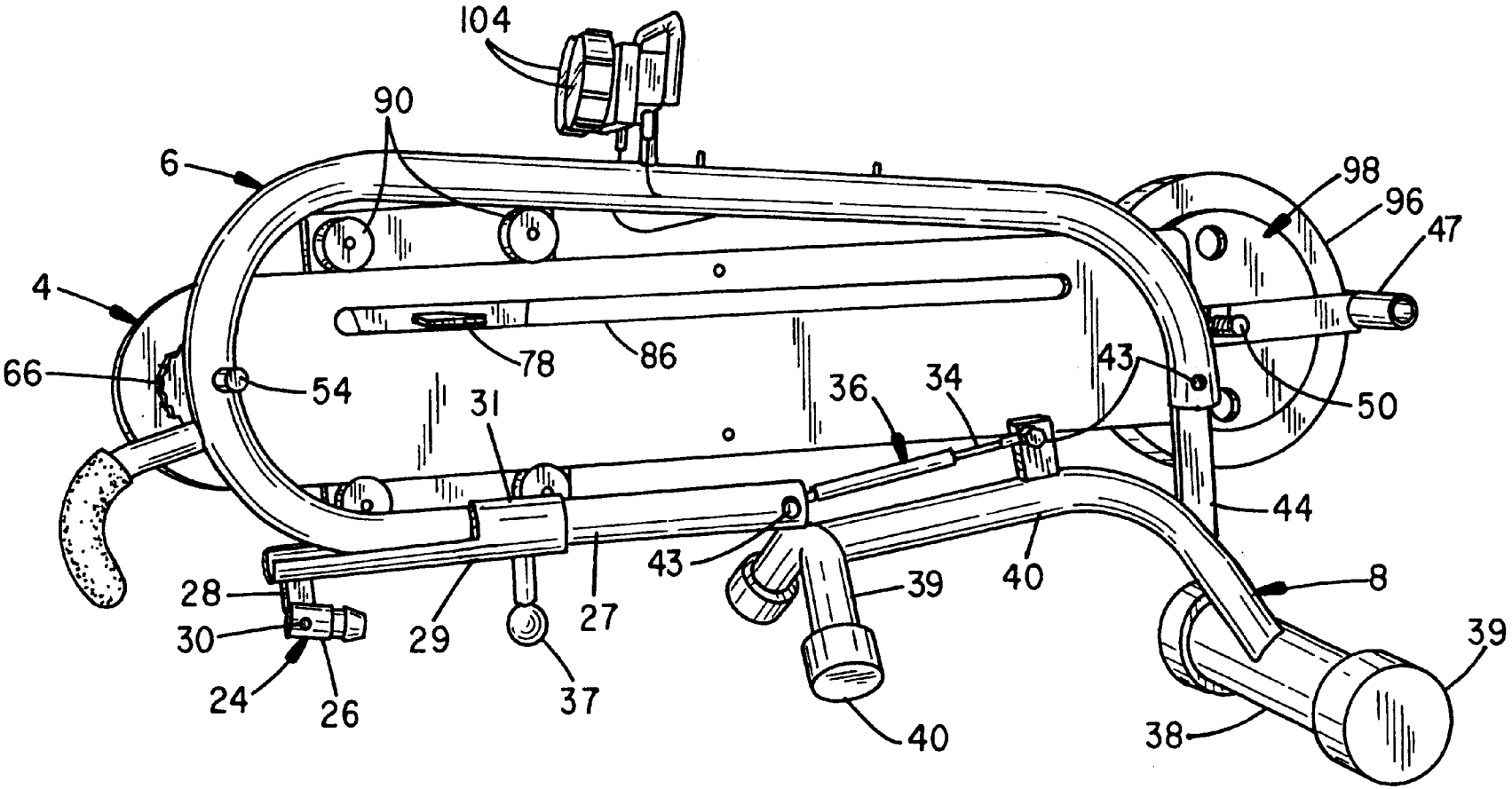
FIG. 4 is a partially disassembled view of the exerciser lowered to a rest or transport position and exposing the longitudinal slide adjuster and spike coupler.

With additional attention to FIG. 4, as the handle end of the main frame 6 is elevated to accommodate the attachment to the clamp coupler assembly 10 and chair, the roller end of the main frame 6 pivots at the base frame 8. A piston 34 of a pneumatic hinge or gas spring 36 self-extends or retracts, as necessary, to establish a desired angular orientation.

The longitudinal displacement of the main frame 6 and drive assemblies 4 and 5 from the chair is set to accommodate the seating posture of the user and the leg extension necessary to operate the pedals. The displacement of the main frame 6 is established at the slide coupler 24 to provide a comfortable extension for normal leg motion of the user relative to the pair of push pedals 7.

Proper longitudinal separation of the main frame 6 is fixed by manipulating the collar 31 and sleeve 29 along the frame section 27. A selected position is fixed by setting a spring biased latch pin 37 that depends from the sleeve 29. When a preferred extension is determined, the pin 37 is fitted to an aligned hole in the frame section 27.

The stability of the exerciser 2 is maintained via a frictional engagement of the base frame 8 with the floor. The base frame 8 includes fore and aft, lateral cross members 38 and 39 that extend from a longitudinal member 40. Cleats 41 at the forward cross member 38 and end caps 42 at the rear cross member 39 provide a non-slip contact with the floor. The forward cleats 41 rotate with the cross member 38 to engage the floor as the main frame is elevated. The cleats 41 and caps 42 can be formed from a variety of materials, e.g. rubber, elastomer, nylon or other materials to enhance the gripping of the support surface. The cleats 41 and caps 42 can include knurling or other grip enhancing surface detailing. Pivot pins 43 secure the longitudinal member 40 to linkage arms 44 that depend from the main frame 6 and to the pneumatic hinge 36.

Transport of the exerciser 2 is facilitated with rollers 45 that are mounted to the ends of the cross member 38. The rollers 45 allow the assembly 2 to roll when drawn or pushed by a handle 46. The handle 46 extends from a forward end of the main frame 6. Between exercise sessions, the exerciser 2 can be detached from the chair at the spike 26 and stored. The clamp coupler 10 can be detached or not as desired. When released from the chair, the pneumatic hinge 36 draws the base frame 8 against the main frame 6 in the fashion of FIG. 4. When stored, the exerciser 2 is supported on a front handrail or bumper 47 and the cross member 38.

Figure 5:
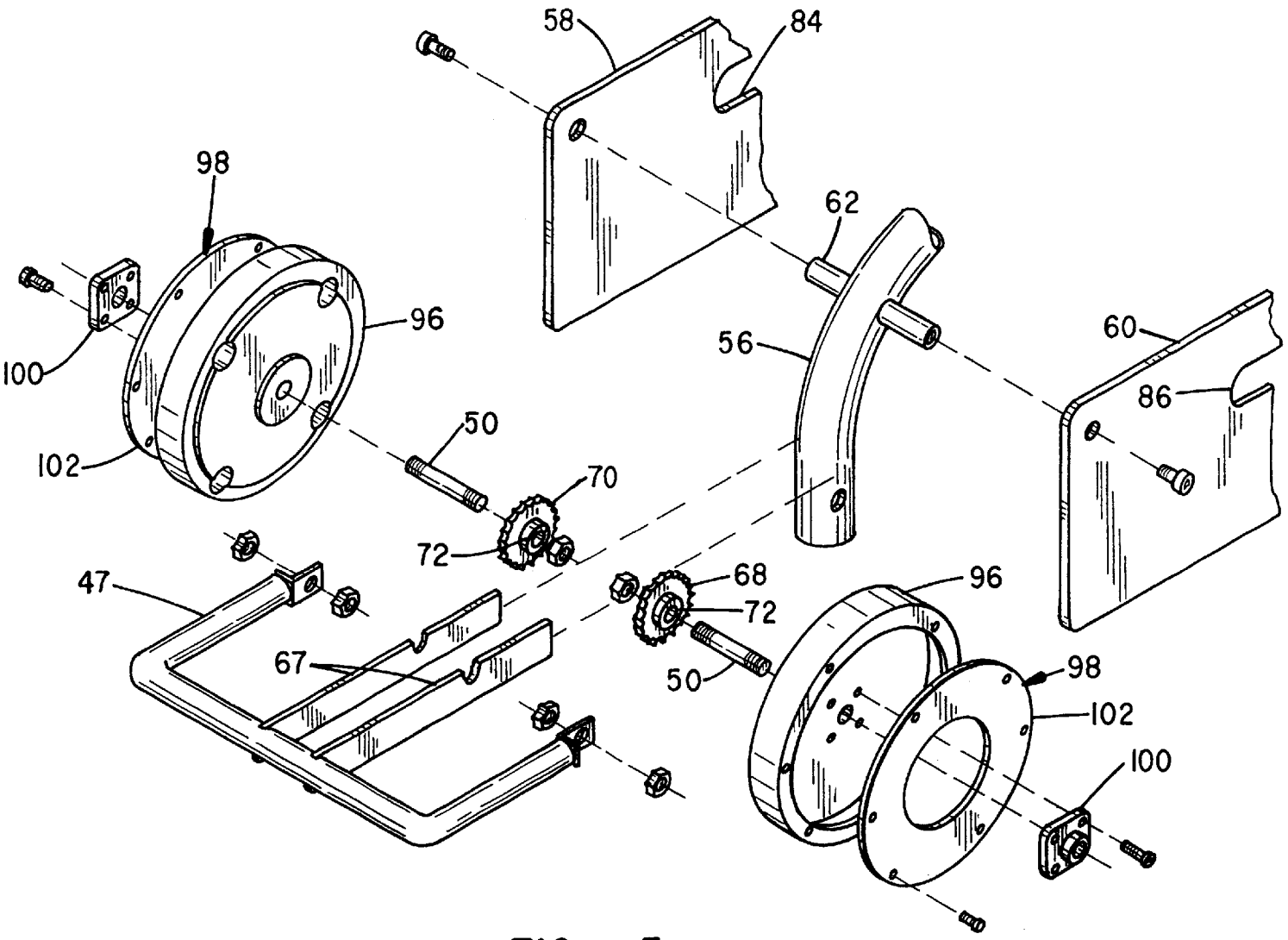
FIG. 5 is a perspective view shown in exploded assembly to the live half axles, overrunning-clutches and the controlled magnetic kinetic and inertial resistance assemblies.

Turning attention to FIG. 5 and referring also to FIG. 2, the drive assembly 4 is secured at one end to one of the live half axles 50 and at an opposite end to a common idler axle 52. The idler axle 52 is supported in a tubular axle housing 54 that projects from an upper frame section 56 of the main frame 6 and includes necessary support bearings and bushings. The axle housing 54 extends from the frame member 56 between a pair of pedal slide rails 58 and 60. Several spacers 62 are mounted along the length and between the slide rails 58 and 60. A pair of idler sprockets 66 are mounted to the idler axle 52 adjacent each of the slide rails 58 and 60.

Each live axle 50 is supported from an arm that extends from the frame member 56 and an end of the handrail 47. The drive axles 50 separately support respective drive sprockets 68 and 70. The sprockets 68 and 70 are supported on over-running clutch assemblies 72 that mount over the respective drive axles 50. Drive chains 74 and 76 extend between the pairs of sprockets 68,52 and 70,52. The right and left pedals 7 are coupled to the drive chains 74 and 76 at linkage arms 78 that extend from pedal slide plates 80 and 82 and through longitudinal slots 84 and 86 at the slide rails 58 and 60. The pedals 7 are secured to the slide plates 80 and 82 at pivot axles 88. Rollers 90 mounted to the corners of the slide plates 80 and 82 constrain the slide plates 80 and 82 to the rails 58 and 60. A user's foot, in turn, is supported to the pedals 7 at heel cups 92 and with length adjustable support straps 94.

Imparting a pushing movement on either pedal 7 induces movement of the associated chain 74 or 76. The movement is transferred to the adjoining chain via the idler axle 52. As one pedal 7 is pushed forward (i.e. down-stroke pedal), the opposite pedal 7 (i.e. up-stroke pedal) is raised. A user can interrupt pedaling at any time without the chains 74 and 76 continuing to drive the opposite pedals 7 due to the over-running clutches 72 at the opposite drive linkages 4 or 5. The user can also initiate downward motion at the rising pedal as desired without waiting until the rising pedal 7 is fully elevated. The pedal stroke length is thus infinitely variable as determined by the user.

Resistance to pedal movement is determined by mounting large mass, flywheels 96 and/or magnetic tension assemblies 98 to the drive axles 50. A combination flywheel 96 and magnetic tension assembly 98 are provided at each of the drive axles 50 of the preferred exerciser. Flywheels 96 can be used alone, where a constant inertial resistance is desired.

The mass of the flywheel 96 establishes an inertial resistance that must be overcome to induce movement of the drive assemblies 4 and 5. Once movement is established, the down-stroke flywheel 96 provides a relatively constant resistance counteracting the pushing action at the down-stroke pedal 48. Upon discontinuing pushing, either during or at the end of a stroke, the down-stroke flywheel 96 rotates freely on its associated over-running clutch 72. The up-stroke flywheel 96, although possibly turning from a prior cycle, during the down-stroke of the opposite drive does not effect pedal resistance at either pedal 7. With the completion of a pedal stroke and transfer of pedal motion to the opposite leg and adjoining pedal 7, the up-stroke flywheel 96 of the previous cycle is engaged by its clutch 72 and then determines pedal resistance.

Although in normal circumstances, the flywheels 96 at the drive axles 50 can exhibit the same mass and resistance, flywheels of different weights can be used at the axles 50. Such a circumstance can arise when accommodating users who suffer a variety of debilitating conditions, for example, stroke patients with limited function on one side versus the other or with amputee users.

The ability to vary the stroke tension or resistance at each flywheel 96 is accommodated with the magnetic tension assemblies 98. The magnetic assemblies 98 permit an independent adjustment of the resistance to movement at each of the drive chains 74 and 76. The assemblies 98 are commercially available from various sources (e.g. Minoura Corp.) and provide a selective magnetic coupling. A magnetic linkage particularly couples the large mass, outer housing or flywheel 96 to a bearing 100 supported inner disk 102 that is secured to the axle 50. Separate control dials 104 and control cable linkages 106 vary the alignment of pole pieces at the assemblies 98 to increase or decrease the coupling between the disks 102 and housings 96 and thereby the resistance to motion. The magnetic tension assemblies 98 provide a range of resistance for the present exerciser 2 similar to that experienced with the operation of a conventional 10-speed bicycle.

While the invention has been described with respect to a number of preferred constructions and considered improvements or alternatives thereto, still other constructions may be suggested to those skilled in the art. It is to be appreciated that selected ones of the foregoing features can be used singularly or be arranged in different combinations. The foregoing description should therefore be construed to include all those embodiments within the spirit and scope of the following claims.

What is claimed is:

1. Exercise apparatus comprising:

a) a base frame having a plurality of support feet;

b) an elongated main frame mounted to pivot from said base frame and including 1) first and second pedals mounted for reciprocating movement along said main frame; 2) an idler axle mounted to said main frame; 3) first and second drive axles mounted to said main frame; 4) means for coupling said first and second pedals to first and second chains respectively trained between said idler axle and said first drive axle and said idler axle and said second drive axle; 5) first and second flywheel means mounted to said first and second drive axles to each rotate independent of the other and only in response to movement of each of said first and second drive chains in a first direction; and c) coupler means for coupling said main frame to a chair, whereby a user can exercise the legs while seated.

2. Exercise apparatus as set forth in claim 1 wherein a pneumatic piston is coupled between said base frame and said main frame.

3. Exercise apparatus as set forth in claim 1 wherein said first and second pedals are mounted to first and second plates that slide along first and second elongated rails mounted to said main flame.

4. Exercise apparatus as set forth in claim 1 wherein said first and second flywheels include means for magnetically controlling the resistance to motion of each of said first and second flywheels relative to said first and second pedals.

5. Exercise apparatus as set forth in claim 1 wherein said coupler means comprises first and second clamp arms mounted to a support member, means for selectively varying the displacement between said first and second clamp arms at said support member.

6. Exercise apparatus as set forth in claim 5 including a slide arm mounted for reciprocating movement along said main frame and a detachable coupler for securing the slide arm to the support member.

7. Exercise apparatus as set forth in claim 1 wherein said base frame includes a cross member containing a plurality of rollers mounted to roll during transport of the apparatus and a plurality of stationary support pads.

8. Exercise apparatus as set forth in claim 1 wherein a pneumatic piston is coupled between said base frame and said main frame and wherein the base frame includes first and second cross members, wherein said first cross member includes rollers, and wherein said first and second cross members include a plurality of stationary support pads, whereby when said main frame is elevated it pivots away from the base frame and said stationary support pads contact a support surface and when the main frame is lowered into contact with the base frame, said rollers engage the support surface for transport.

9. Exercise apparatus comprising:

a) a base frame including a plurality of support feet;

b) an elongated main frame including 1) first and second pedals mounted for reciprocating movement along first and second rails of said main frame; 2) an idler axle mounted between said first and second rails; 3) first and second drive axles respectively mounted to said first and second rails; 4) means coupling said first and second pedals to first and second chains respectively trained between said idler axle and said first drive axle,and said idler axle and said second drive axle; 5) first and second flywheels mounted to said first and second drive axles to each rotate independent of the other and only in response to movement of said first and second drive chains in a first direction;

c) piston means mounted between said main frame and said base frame for biasing a pivoting movement between said main frame and said base frame; and d) coupler means for coupling said main frame to a chair, whereby a user can exercise the legs while seated.

10. Exercise apparatus as set forth in claim 9 wherein said coupler means comprises a slide arm mounted for reciprocating movement along said main frame, first and second clamp arms mounted to a support member, means for selectively varying the displacement between said first and second clamp arms at said support means and a detachable coupler for securing the slide arm to the support member.

11. Exercise apparatus as set forth in claim 9 wherein said first and second pedals are mounted to first and second plates, wherein rollers at said first and second plates engage said first and second rails.

12. Exercise apparatus as set forth in claim 9 wherein said first and second flywheels include means for magnetically controlling the resistance to motion of each of said first and second flywheels.

13. Exercise apparatus comprising:

a) a base frame including a plurality of support feet;

b) an elongated main frame including 1) first and second pedals mounted to pivot at first and second plates and supported for reciprocating movement along first and second elongated rails mounted to said main frame; 2) an idler axle mounted between said first and second rails; 3) first and second drive axles mounted between said first and second rails; 4) means coupling said first and second pedals to first and second chains respectively trained between said idler axle and said first drive axle, and said idler axle and said second drive axle; 5) first and second flywheels mounted to said first and second drive axles to each rotate independent of the other and only in response to movement of said first and second drive chains in a first direction;

c) piston means mounted between said main frame and said base frame for biasing a pivoting movement between said main frame and said base frame; and d) coupler means for coupling said main frame to a chair, whereby a user can exercise the legs while seated.

14. Exercise apparatus as set forth in claim 13 wherein said coupler means comprises first and second clamp arms mounted to a support member, means for selectively varying the displacement between said first and second clamp arms at the support member.

15. Exercise apparatus as set forth in claim 14 including a slide arm mounted for reciprocating movement along said main frame and a detachable coupler for securing the slide arm to the support member.

16. Exercise apparatus as set forth in claim 13 wherein each of said first and second flywheels includes means for magnetically controlling the resistance to motion of said first and second flywheels.

17. Exercise apparatus as set forth in claim 13 wherein each of said first and second flywheels comprises a disk secured to said first and second drive axles and a housing displaced from said disk and means for magnetically controlling the coupling between said disk and housing, whereby the resistance to motion of said first and second flywheels is independently varied.

* * * * *